US012102870B2

(12) United States Patent
Aoki

(10) Patent No.: US 12,102,870 B2
(45) Date of Patent: Oct. 1, 2024

(54) ROWING EXERCISE SYSTEM

(71) Applicant: TOYOTA JIDOSHA KABUSHIKI KAISHA, Toyota (JP)

(72) Inventor: Eisuke Aoki, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 265 days.

(21) Appl. No.: 17/850,196

(22) Filed: Jun. 27, 2022

(65) Prior Publication Data

US 2022/0409955 A1 Dec. 29, 2022

(30) Foreign Application Priority Data

Jun. 29, 2021 (JP) ..... 2021-107436

(51) Int. Cl.
*A63B 23/04* (2006.01)
*A47C 9/00* (2006.01)
*A63B 22/18* (2006.01)

(52) U.S. Cl.
CPC ..... *A63B 23/0476* (2013.01); *A47C 9/002* (2013.01); *A63B 22/18* (2013.01)

(58) Field of Classification Search
CPC . A47C 9/002; A63B 21/4007; A63B 21/4027; A63B 21/4041; A63B 21/4047; A63B 21/4049; A63B 22/0605; A63B 22/18; A63B 23/0476; A63B 23/02; A63B 23/04; A63B 2225/09; A63B 2208/0233
See application file for complete search history.

(56) References Cited

U.S. PATENT DOCUMENTS

| | | | | |
|---|---|---|---|---|
| 4,850,587 | A * | 7/1989 | Lin | A63B 21/154 482/95 |
| 6,893,098 | B2 * | 5/2005 | Kohani | A47C 7/425 297/468 |
| 7,775,944 | B1 * | 8/2010 | Shultz | A63B 22/18 601/87 |
| 10,486,046 | B2 * | 11/2019 | Milovich | A63B 23/0476 |
| 11,857,833 | B2 * | 1/2024 | Aoki | A63B 22/0664 |
| 2009/0197744 | A1 | 8/2009 | Yamazaki | |
| 2012/0292968 | A1 * | 11/2012 | Lee | A47C 7/441 297/313 |

(Continued)

FOREIGN PATENT DOCUMENTS

| | | | |
|---|---|---|---|
| AU | 2019101329 | A4 | 12/2019 |
| CN | 1208357 | A | 2/1999 |

(Continued)

OTHER PUBLICATIONS

Evolving the Work Style of Japan's "Too Sedentary Country", News Letter Kokuyo Co., Ltd., https://www.kokuyo.co.jp/newsroom/news/assets/pdf/20171106_NewsLetter.pdf, 3 pages, Nov. 6, 2017.

*Primary Examiner* — Megan Anderson
(74) *Attorney, Agent, or Firm* — Dinsmore & Shohl LLP

(57) ABSTRACT

A lower limb exercise system exercise system includes a chair including a seat and a rowing exercise device configured to enable a user to perform rowing exercise while the user remains sitting on the seat. The seat is configured to at least roll, pitch, or yaw. The seat can instead be configured to at least roll and yaw. The rolling of the seat indicates that the seat descends as the seat moves away to the right or the left from a reference position.

16 Claims, 15 Drawing Sheets

(56) References Cited

U.S. PATENT DOCUMENTS

| | | | | |
|---|---|---|---|---|
| 2019/0045928 | A1 | 2/2019 | Yajima et al. | |
| 2020/0047024 | A1* | 2/2020 | Tsai | A63B 22/0694 |
| 2020/0047068 | A1* | 2/2020 | Amar | A63F 13/803 |
| 2020/0196763 | A1 | 6/2020 | Yajima et al. | |
| 2022/0362628 | A1* | 11/2022 | Polinsky | A63B 22/0664 |
| 2023/0330477 | A1* | 10/2023 | Aoki | A63B 24/0087 |
| 2023/0337827 | A1* | 10/2023 | Pinkelman | A47C 7/462 |
| 2024/0001215 | A1* | 1/2024 | Nakashima | A63B 71/0622 |

FOREIGN PATENT DOCUMENTS

| | | | |
|---|---|---|---|
| CN | 106581944 | A | 4/2017 |
| CN | 108430270 | A | 8/2018 |
| EP | 0878216 | A1 | 11/1998 |
| GB | 2436074 | A | 9/2007 |
| JP | H10-094577 | A | 4/1998 |
| JP | 0878216 | A1 * | 11/1998 |
| JP | 2001333948 | A | 12/2001 |
| JP | 2009160351 | A | 7/2009 |
| JP | 2011101727 | A | 5/2011 |
| JP | 3182332 | U | 3/2013 |
| JP | 2021-137644 | A | 9/2021 |
| WO | 2008001476 | A1 | 1/2008 |

* cited by examiner

ROWING EXERCISE SYSTEM

CROSS REFERENCE TO RELATED APPLICATIONS

This application is based upon and claims the benefit of priority from Japanese patent application No. 2021-107436, filed on Jun. 29, 2021, the disclosure of which is incorporated herein in its entirety by reference.

BACKGROUND

The present disclosure relates to a rowing exercise system that achieves a motion linkage between lower limbs and a trunk.

Japanese Unexamined Patent Application Publication No. H10-94577 discloses an exercise device that enables a user to pedal in a sitting position.

SUMMARY

In the configuration of Japanese Unexamined Patent Application Publication No. H10-94577, when a user performs a rowing exercise in a sitting position, it is desirable to perform the exercise using not only the lower limbs but also the trunk. However, as long as the seat is fixed, the posture of the pelvis is restrained, and thus a motion linkage between the lower limbs and the trunk cannot occur.

An object of the present disclosure is to provide a technique that achieves a motion linkage between lower limbs and a trunk when a user performs rowing exercise while remaining in a sitting position.

According to an example aspect of the present disclosure, a rowing exercise system includes: a chair including a seat on which a user sits; and a rowing exercise device configured to enable the user to perform rowing exercise while the user remains sitting on the seat. The seat may be configured to at least roll, pitch, or yaw.

The seat may be configured to at least roll and yaw.

The rolling of the seat may indicate that the seat descends as the seat moves away to the right or the left from a reference position.

The chair may further include biasing member configured to bias the seat toward the reference position.

The chair may further include: a movable part including the seat; a supporting part configured to support the movable part in such a way that the movable part can be moved to the right and to the left; and a backrest part fixed to the supporting part.

The chair may further include a fixing member configured to fix the trunk of the user to the backrest part.

The fixing member is configured to fix a part of the trunk of the user above the solar plexus to the backrest part.

The fixing member is configured to fix the base of the neck or the shoulder blade of the trunk of the user to the backrest part.

The chair may further include a headrest fixed to the supporting part.

According to the present disclosure, a motion linkage between lower limbs and a trunk is achieved when a user performs rowing exercise while remaining in a sitting position.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

Although regular moderate exercise is suitable for maintaining good health, it is necessary to secure a regular time for exercise in order to do exercise regularly, and thus busy people tend to not exercise enough. However, even if it is difficult to secure a regular time for exercise, as long as a person can exercise his/her lower limbs while he/she remains in a sitting position, a certain amount of exercise can be done.

As exercise devices that enable a user to exercise his/her lower limbs while he/she remains in a sitting position, rowing exercise devices have been known.

As a result of thorough research, the present inventors have found that causing a motion linkage to occur between the lower limbs and the trunk increases the effect of exercise obtained by exercising the lower limbs while a user remains in a sitting position, and have more particularly found that, if this motion linkage is made to occur during exercise of lower limbs while the user remains in the sitting position, exercise of trunk muscles represented by the rectus abdominis, transversus abdominis, and erector spinae muscles can be provided as well. The present inventors have also found that, when a user exercises his/her lower limbs while he/she remains in the sitting position, if the seat on which the user sits is fixed, a movement of the pelvis becomes slow, which inhibits the motion linkage between the lower limbs and the trunk, and thus that the motion linkage between the lower limbs and the trunk can be achieved by making the seat unstable.

If the exercise of the trunk muscles can be provided as described above, first, it is expected that the waist size of the user will be reduced. Second, since the rectus abdominis, transversus abdominis, and erector spinae muscles are strengthened, it becomes easy to maintain a posture in which the pelvis is tilted forward, which may contribute to solving problems such as a hunchback and a straight neck.

Further, if the motion linkage between the lower limbs and the trunk can be achieved as described above, the pelvis can be moved rapidly, which increases the flexibility of, in particular, the iliopsoas muscle and is expected to reduce chronic low back pain.

First Embodiment

Hereinafter, with reference to FIGS. 1 to 14, a first embodiment will be described.

Figure 1:
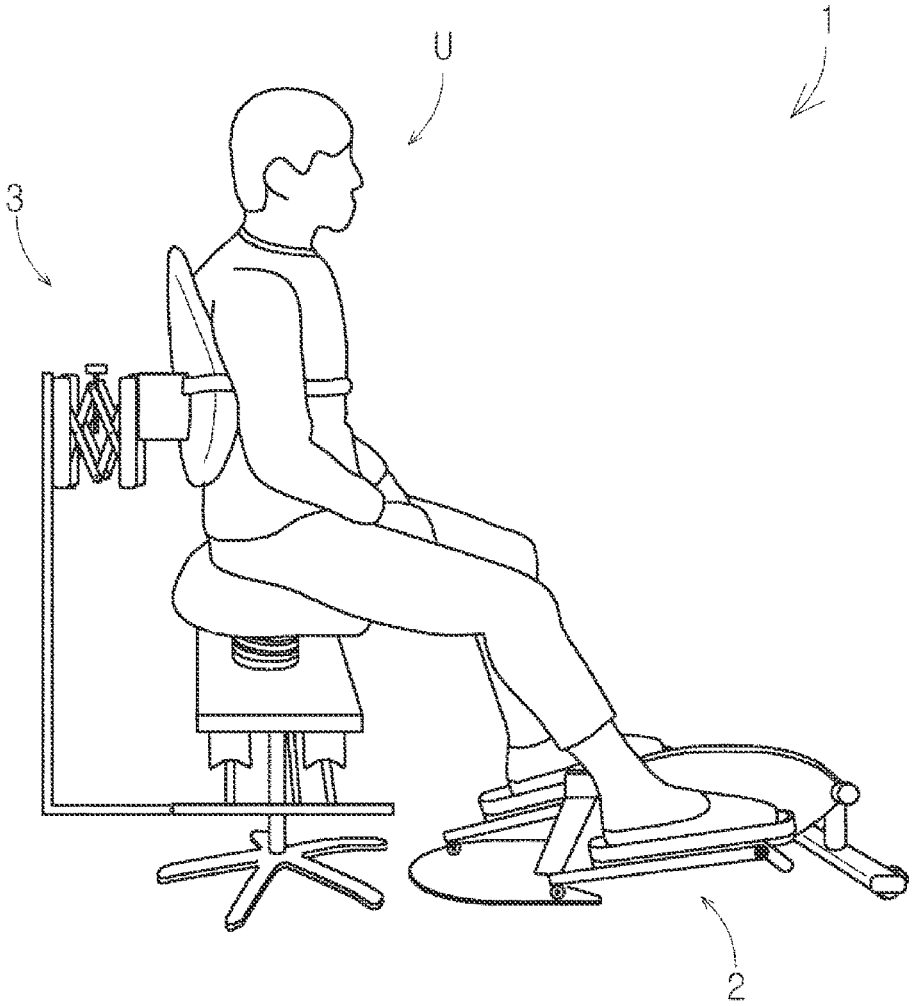
FIG. 1 is a side view of a lower limb exercise system.

FIG. 1 shows a lower limb (pedaling) exercise system 1. The lower limb exercise system 1 is one specific example of a rowing exercise system. As shown in FIG. 1, the lower limb exercise system 1 includes a rowing (pedaling) exercise device 2 and a chair 3.

The rowing exercise device 2 is a device used for rowing exercise while the user remains in the sitting position.

The chair 3 is a chair on which the user U sits when he/she performs a rowing exercise. In this embodiment, the chair 3 is separated from the rowing exercise device 2. Therefore, the distance between the rowing exercise device 2 and the chair 3 can be adjusted. However, the chair 3 may instead be integrally formed with the rowing exercise device 2.

Figure 2:
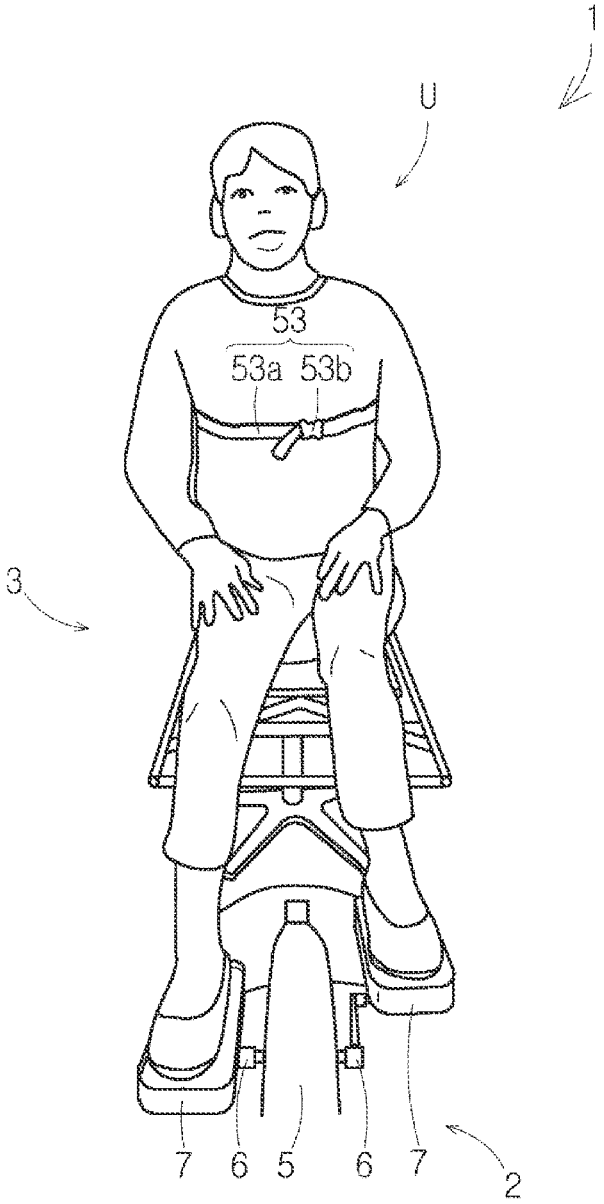
FIG. 2 is a front view of the lower limb exercise system.
Figure 3:
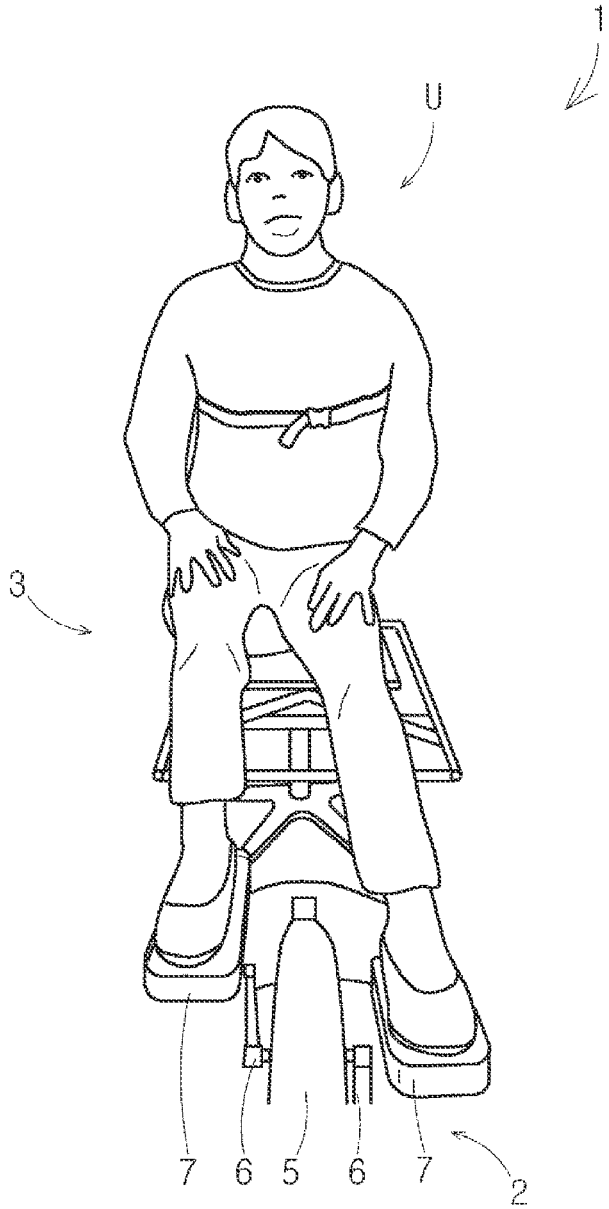
FIG. 3 is a front view of the lower limb exercise system.

FIGS. 2 and 3 each show a state in which the user U is doing exercise using the lower limb exercise system 1.

As shown in FIG. 2, the rowing exercise device 2 includes a device body 5 that rotatably supports an output axis, a pair of cranks 6 attached to the output axis, and a pair of pedals 7 attached to the pair of respective cranks 6. As shown in FIGS. 2 and 3, the user U performs rowing exercise by putting his/her both feet on the pair of pedals 7 and alternately stepping out. The device body 5 is configured to be able to adjust the load on the rotation of the output axis. The user U is able to perform rowing exercise with his/her preferred exercise load by adjusting the load on the rotation of the output axis.

Figure 4:
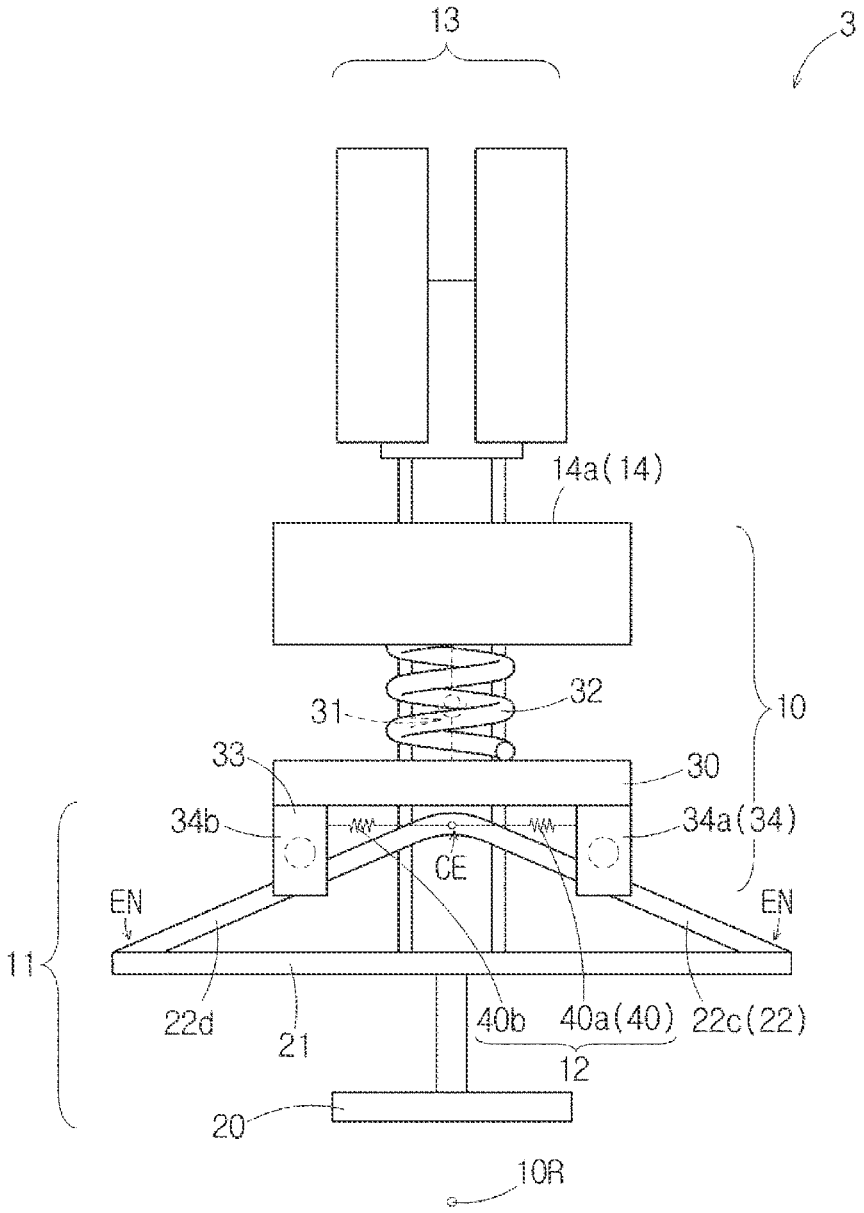
FIG. 4 is a front view of a chair.

FIG. 4 shows a front view of the chair 3. As shown in FIG. 4, the chair 3 includes a movable part 10, a supporting part 11, a restoration unit 12, and a stabilizing part 13.

The movable part 10 includes a seat 14 on which the user U sits.

The supporting part 11 supports the movable part 10 in such a way that it can be moved to the right and to the left. The "right and left" here is defined to be the right and the left seen from the user U. Likewise, "back and forth" or "backward and forward" is defined to be back and forth or backward and forward seen from the user U.

The restoration unit 12 biases the movable part 10 toward the neutral position in the right and the left. In FIG. 4, the movable part 10 is positioned at the neutral position. The neutral position is one specific example of a reference position.

Then, the supporting part 11 supports the movable part 10 in such a way that the movable part 10 descends as it is away from the neutral position.

The user U performs rowing exercise using the rowing exercise device 2 while sitting on the seat 14 of the chair 3.

According to the aforementioned configuration, the chair 3 that can be provided for a low cost, is highly convenient, and is capable of providing highly effective exercise can be provided.

Hereinafter, the chair 3 will be described in detail.

(Supporting Part 11)

The supporting part 11 is placed on the floor surface in a fixed manner. The supporting part 11 includes a leg part 20, a frame 21, and two rails 22.

The leg part 20 is a part that contacts the floor surface on which the chair 3 is installed.

Figure 5:
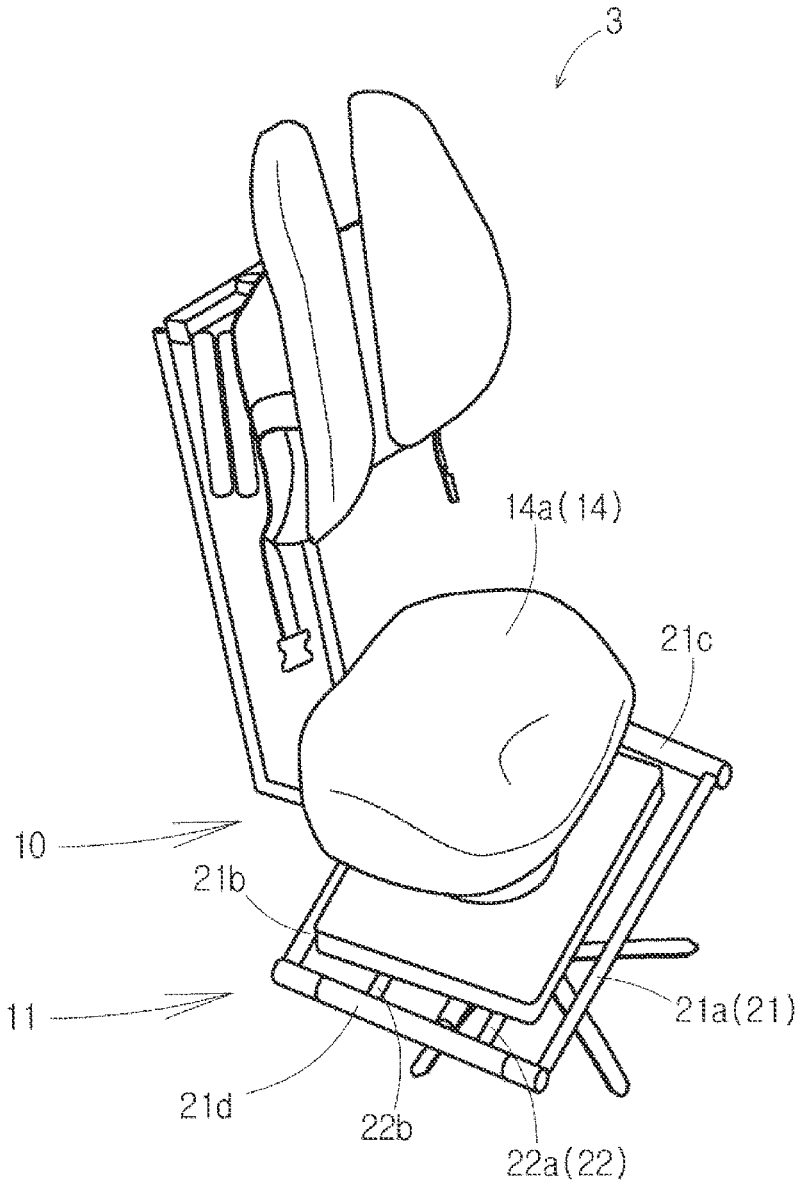
FIG. 5 is a perspective view of the chair.
Figure 6:
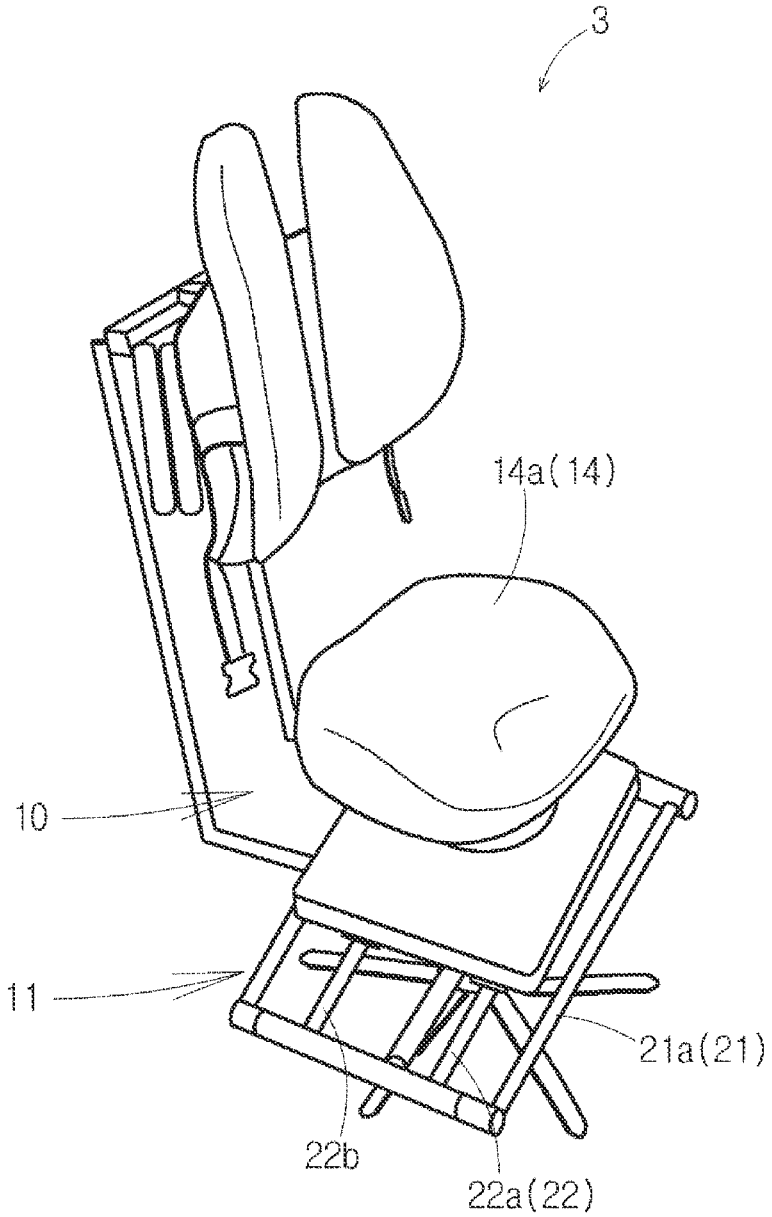
FIG. 6 is a perspective view of the chair.

The frame 21, which is supported by the leg part 20, supports the two rails 22. As shown in FIG. 5, the frame 21 includes a front frame part 21*a* disposed in the front, a back frame part 21*b* disposed in the back, a left frame part 21*c* disposed on the left side, and a right frame part 21*d* disposed on the right side. The front frame part 21*a*, the back frame part 21*b*, the left frame part 21*c*, and the right frame part 21*d* are coupled to one another so as to form a rectangle in a plan view. That is, the front frame part 21*a* and the back frame part 21*b* are coupled to each other via the left frame part 21*c* and the right frame part 21*d*. The left frame part 21*c* couples one end of the front frame part 21*a* to one end of the back frame part 21*b*. The right frame part 21*d* couples the other end of the front frame part 21*a* to the other end of the back frame part 21*b*.

The two rails 22 define the trajectory of the movement of the movable part 10 in the right and the left. The two rails 22 are disposed between the left frame part 21*c* and the right frame part 21*d*. The two rails 22 are extended from the left frame part 21*c* to the right frame part 21*d*. The two rails 22 couple the left frame part 21*c* to the right frame part 21*d*. The two rails 22 are disposed in the front-back direction so as to be away from each other. That is, the two rails 22 include a front rail part 22*a* disposed in the front and a back rail part 22*b* disposed in the back. Referring once again to FIG. 4, each of the rails 22 is bent so as to be convex upward. That is, each of the rails 22 is inclined so as to descend toward an end part EN thereof from a center CE thereof in the longitudinal direction of each of the rails 22. Each of the rails 22 is inclined so as to approach the floor surface toward the end part EN thereof from the center CE thereof in the longitudinal direction of each of the rails 22. In this embodiment, each of the rails 22 is formed in a V shape that is convex upward and opens downward. Therefore, the movable part 10 is guided so as to descend as it moves away from the neutral position when the movable part 10 moves in the right and the left along the two rails 22. In other words, as shown in FIG. 4, the supporting part 11 supports the movable part 10 in such a way that the movable part 10 is swung to the right and to the left about a roll axis 10R that is extended backward and forward, that is, in such a way that it rolls about the roll axis 10R. The roll axis 10R is set to be lower than the movable part 10 when the movable part 10 is positioned at the neutral position. The centroid point of the movable part 10 is guided so as to descend as it moves away from the neutral position when the movable part 10 moves in the right and the left along the two rails 22. Each of the rails 22 includes a left rail part 22*c* that is extended to the left from the center of the rail in the longitudinal direction of each of the rails 22 and a right rail part 22*d* that is extended to the right from the center of the rail in the longitudinal direction of each of the rails 22.

While each of the rails 22 has a V shape that is convex upward and opens downward in this embodiment, the shape of each of the rails 22 is not limited thereto. Each of the rails 22 may be a U shape that is convex upward and opens downward or a curved shape that is convex upward and opens downward. Each of the rails 22 may be extended typically in an arc shape or an elliptical arc shape so as to be convex upward and open downward.

In this embodiment, the left rail part 22*c* and the right rail part 22*d* that compose each of the rails 22 are integrally formed. However, the left rail part 22*c* and the right rail part 22*d* may be separated from each other and may be disposed so as to be away from each other.

(Movable Part 10)

Referring continuously to FIG. 4, the movable part 10 will be described.

As shown in FIG. 4, the movable part 10 includes a movable part body 30, the seat 14, a universal joint 31, a coil spring 32, and a pair of coupling units 33.

The pair of coupling units 33, the movable part body 30, and the seat 14 are disposed in this order in a direction away from the floor surface. The universal joint 31 and the coil spring 32 are disposed between the movable part body 30 and the seat 14.

Figure 7:
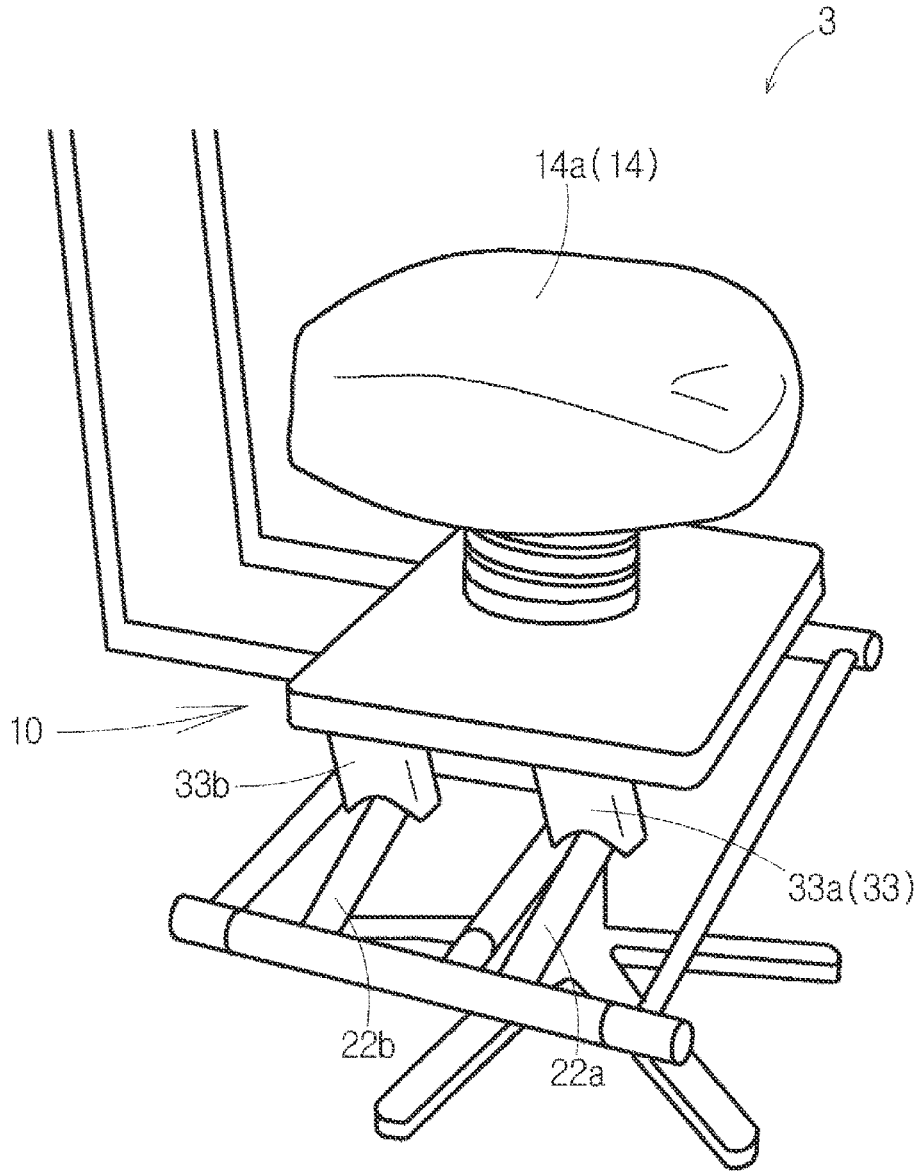
FIG. 7 is a perspective view of the chair.

The movable part body 30 is a plate body interposed between the supporting part 11 and the seat 14. The pair of coupling units 33 are provided on the lower surface of the movable part body 30. As shown in FIG. 7, the pair of coupling units 33 include a front coupling unit 33*a* and a back coupling unit 33*b*. The front coupling unit 33*a* corresponds to the front rail part 22*a*. The back coupling unit 33*b* corresponds to the back rail part 22*b*. Referring once again to FIG. 4, each of the coupling units 33 includes a pair of respective coupling parts 34. The pair of coupling parts 34 include a left coupling part 34*a* and a right coupling part 34*b*. The left coupling part 34*a* is slidably coupled to the left rail part 22*c*. The right coupling part 34*b* is slidably coupled to the right rail part 22*d*. For example, the left coupling part 34*a* may include a wheel rolling on the corresponding left rail part 22*c*, the wheel being shown by a dashed line, and a bracket that rotatably holds the wheel. The same holds true for the right coupling part 34*b*.

Figure 8:
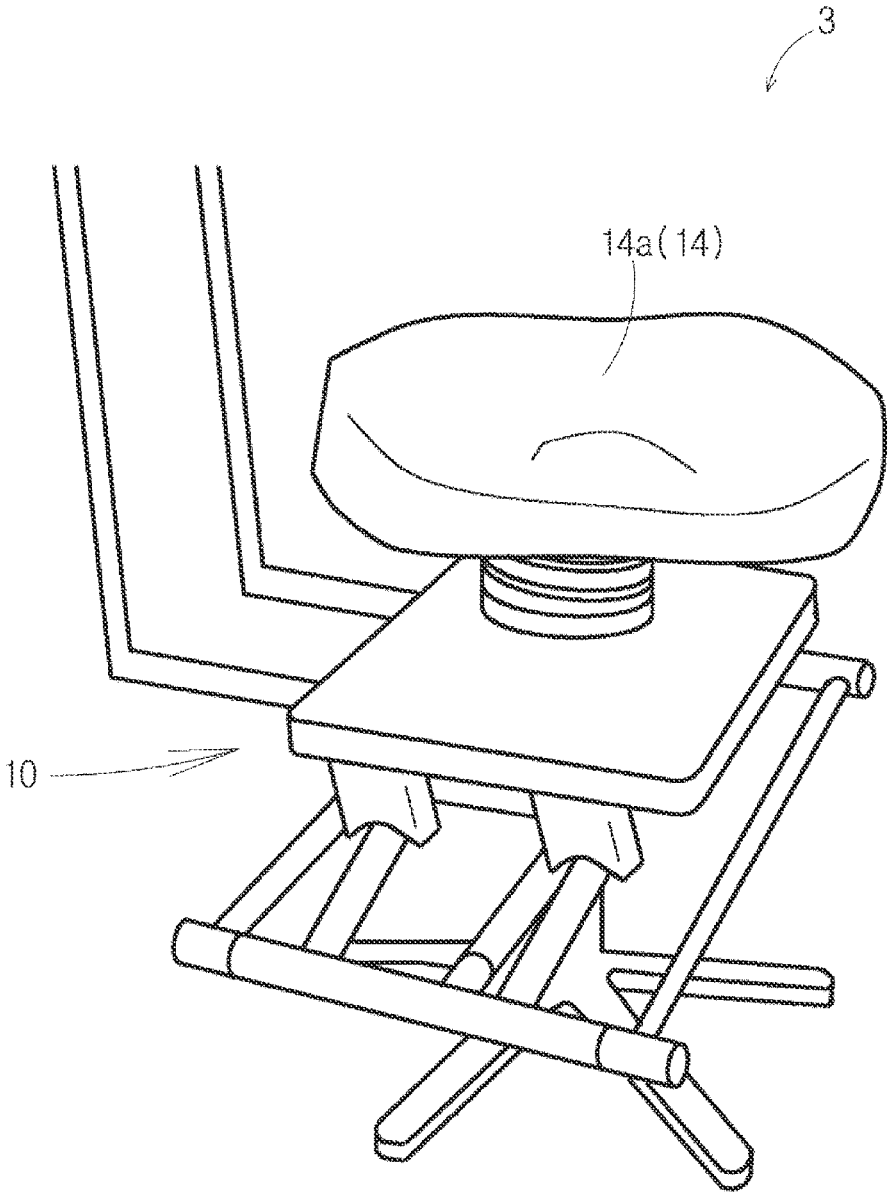
FIG. 8 is a perspective view of the chair.
Figure 9:
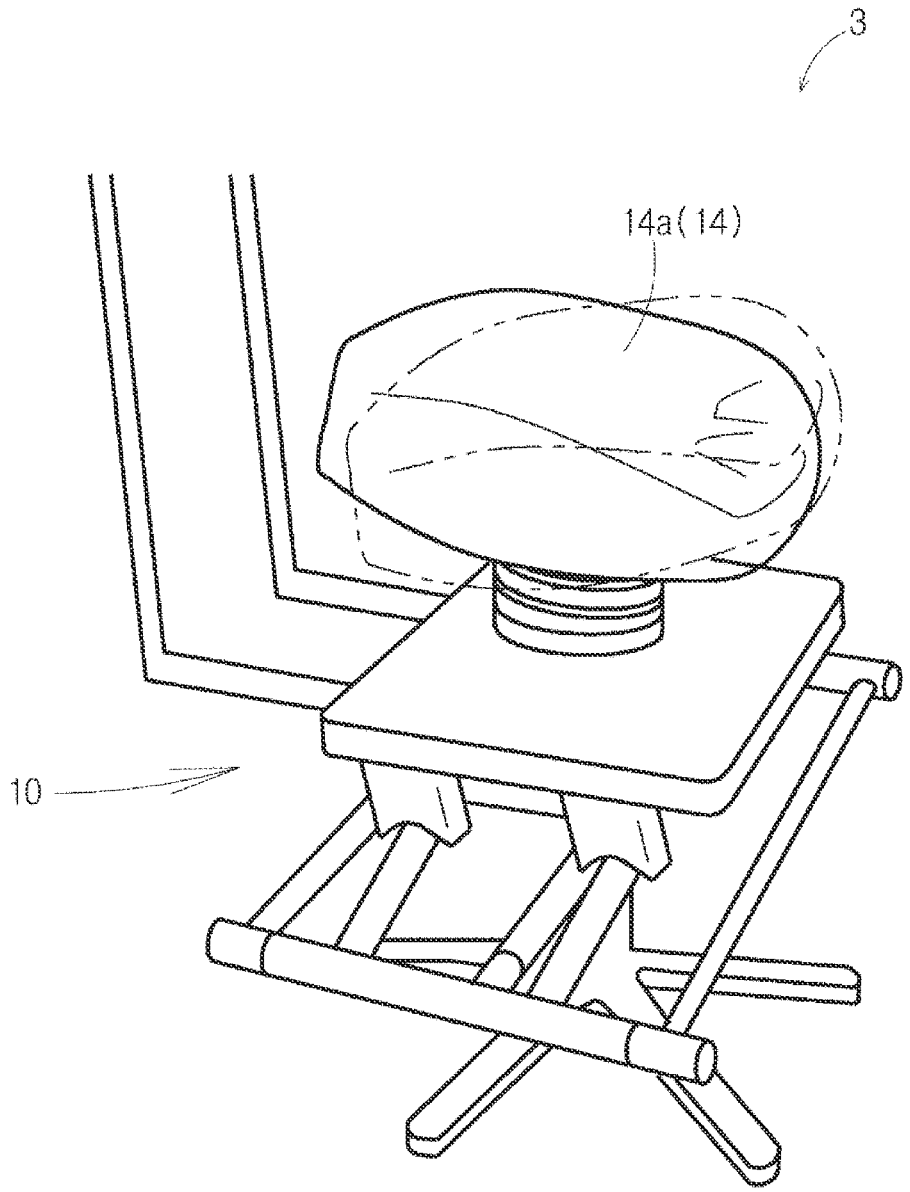
FIG. 9 is a perspective view of the chair.
Figure 10:
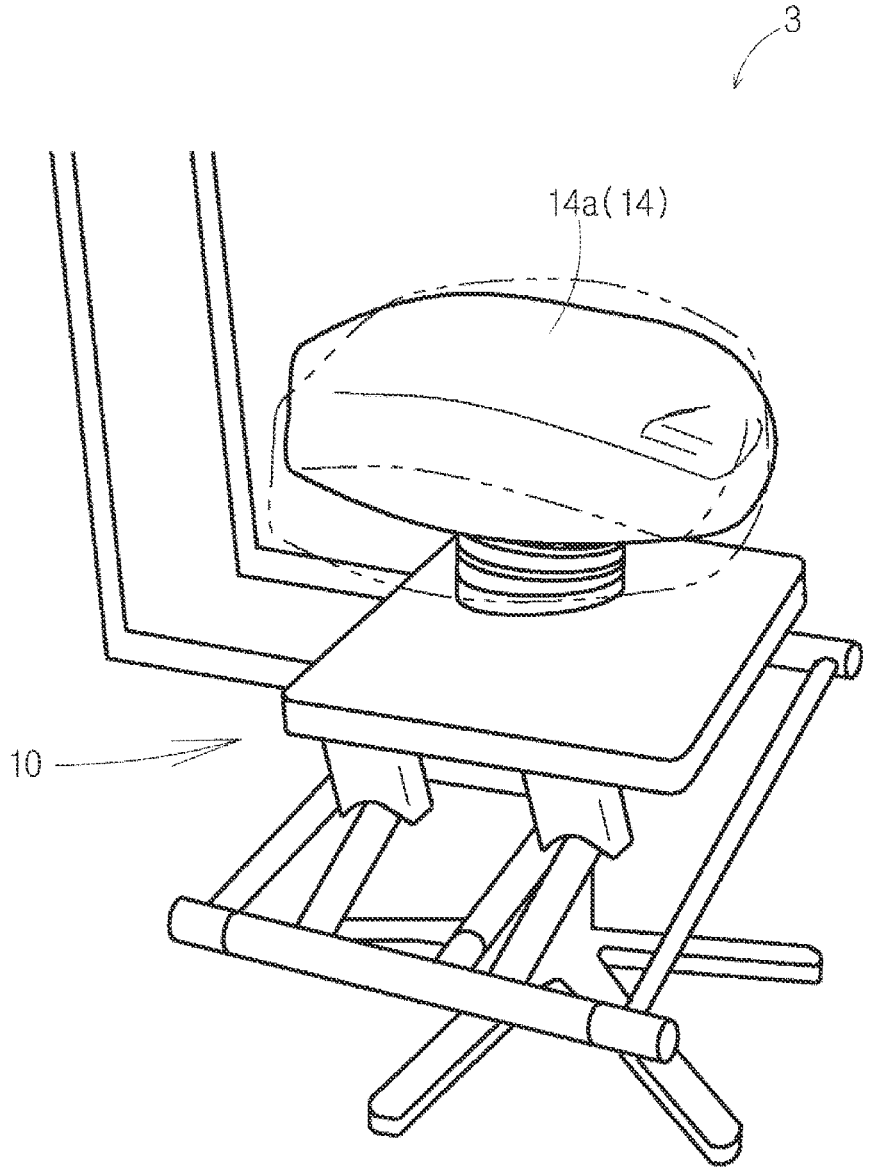
FIG. 10 is a perspective view of the chair.

The seat 14 and the movable part body 30 are coupled to each other by the universal joint 31. Therefore, the seat 14 is supported by the movable part body 30 in such a way that it can turn around a yaw axis as shown in FIGS. 7 and 8. That is, the seat 14 is configured in such a way that it can yaw. The "yaw" means that it turns around the yaw axis. The "yaw axis" here means an axis that is extended along the vertical direction, which is a direction in which the gravity acts. Alternatively, the "yaw axis" may be an axis that is extended along the thickness direction of the movable part body 30. Likewise, the seat 14 is supported by the movable part body 30 so that it can be tilted backward and forward with respect to the movable part body 30, as shown in FIG. 9. That is, the seat 14 is configured in such a way that it can pitch. The "pitch" means that it turns around a pitch axis. The "pitch axis" here means an axis that is extended in the right and the left. The pitch axis passes through a joint part 31*a* of the universal joint 31. Therefore, the pitch axis is set to be lower than the seat 14. Likewise, the seat 14 is supported by the movable part body 30 so that it can be tilted to the right and to the left with respect to the movable part body 30 as shown in FIG. 10. That is, the seat 14 is configured so that it can roll not only by the movable part body 30 and the supporting part 11 but also by the universal joint 31. The roll of the seat 14 by the universal joint 31 means turning about the roll axis that passes through the joint part 31*a* of the universal joint 31. The "roll axis" means an axis that is extended backward and forward.

Referring once again to FIG. 4, the coil spring 32 that resists tilting of the seat 14 with respect to the movable part body 30 is disposed between the seat 14 and the movable part body 30. The upper end of the coil spring 32 contacts the seat 14 and the lower end of the coil spring 32 contacts the movable part body 30. In this embodiment, the coil spring 32 is coaxially disposed with the universal joint 31. In other words, the coil spring 32 is disposed so as to house the universal joint 31 inside a helical structure of the spring. When, for example, the seat 14 is tilted forward with respect to the movable part body 30, the upper end of the coil spring 32 is elastically displaced forward, and at the same time, an elastic restoring force of the coil spring 32 causes the seat 14 to return to the state before the tilting. Note that the upper end of the coil spring 32 is not fixed to the seat 14 so as not to inhibit turn of the seat 14 about the yaw axis with respect to the movable part body 30.

The user U sits on the seat 14. The seat 14 includes a seating surface 14*a* opposed to the buttocks of the user U. The seating surface 14*a* is inclined forward in such a way that the pelvis of the user U is inclined forward when the user U sits on the seat 14. That is, the front part of the seating surface 14*a* is lower than the back part thereof.

(Restoration Unit 12)

The restoration unit 12 is one specific example of biasing member. The restoration unit 12 biases the movable part 10 toward the neutral position in the right and the left. In this embodiment, the restoration unit 12 is an elastic body. That is, the restoration unit 12 includes a pair of restoring coil springs 40. The pair of restoring coil springs 40 include a left restoring coil spring 40*a* that is provided between the center CE of each of the rails 22 and the left coupling part 34*a* and a right restoring coil spring 40*b* that is provided between the center CE of each of the rails 22 and the right coupling part 34*b*. The left restoring coil spring 40*a* and the right restoring coil spring 40*b* are formed as separate bodies.

When the movable part 10 moves to the left with the aforementioned configuration, the left restoring coil spring 40*a* is elongated and the elastic restoring force of the left restoring coil spring 40*a* biases the movable part 10 toward the neutral position. Likewise, when the movable part 10 moves to the right, the right restoring coil spring 40*b* is elongated, and the elastic restoring force of the right restoring coil spring 40*b* biases the movable part 10 toward the neutral position.

While the elastic body that forms the restoration unit 12 is a coil spring in this embodiment, it may instead be another elastic body such as rubber.

While the restoration unit 12 is formed of the pair of restoring coil springs 40 in this embodiment, it may instead be composed of one coil spring. In this case, in general, one coil spring is provided between the left coupling part 34*a* and the right coupling part 34*b*, and the center of one coil spring in the longitudinal direction is fixed to the center CE. The restoration unit 12 may be provided between the frame 21 and the movable part 10 instead of being provided between each of the rails 22 and the movable part 10.

When the user U kicks out his/her right leg as shown in FIG. 2 with the aforementioned configuration, his/her pelvis slightly moves to the right side, which causes the movable part body 30 to slightly move to the right side. At this time, since each of the rails 22 is inclined so as to descend toward the end part EN thereof from the center CE thereof, the movement of the movable part body 30 to the right side is amplified and the amount of movement of the pelvis increases. Since the pelvis moves a lot, the trunk muscles of the user U are activated in conjunction with a stepping motion of the shank of the user U, which provides exercise of the trunk muscles. The same holds true for a case in which the user U kicks out his/her left leg.

Further, when the user U kicks out his/her right leg, his/her pelvis turns in a counterclockwise direction around the yaw axis in a plan view. Since the seat 14 is configured so as to be able to turn about the yaw axis with respect to the movable part body 30, this pelvic turning movement is smoothly performed. The same holds true for a case in which the user U kicks out his/her left leg. In this manner, the pelvis moves in the right and the left and turns about the yaw axis, which causes the pelvis to be inclined forward and thus leads the user U to maintain a good posture with his/her pelvis stood upright.

The meaning that the restoration unit 12 is provided will be explained. If the restoration unit 12 is not provided, once the movable part 10 is deviated from the neutral position in the right and the left, it is difficult to return the movable part 10 to the neutral position. Specifically, although the user U is able to instantaneously release the load on the movable part 10, it is difficult for the user U to return the movable part 10 to the neutral position at the same timing. On the other hand, when the restoration unit 12 is provided, the user U only needs to instantaneously release the load on the movable part 10 so that the movable part 10 is biased toward the neutral position, whereby the movable part 10 can be easily returned to the neutral position using the inertia obtained when the movable part 10 is biased. In some embodiments, the elastic restoring force of the restoration unit 12 can be changed in accordance with the physique and muscle strength of the user U. That is, when a user U who is not familiar with the use of trunk muscles uses the chair 3, the spring constant of the restoration unit 12 may be set to be large, so that the movable part 10 proactively returns to the neutral position. On the other hand, when a user U who is familiar with the use of trunk muscles uses the chair 3, the spring constant of the restoration unit 12 may be set to be small. When the spring constant of the restoration unit 12 is small, the movable part 10 does not tend to return to the neutral position, and trunk muscles need to be activated every time the movable part 10 is made to return to the neutral position. In this way, by changing the spring constant of the restoration unit 12, the load applied to the trunk muscles can be adjusted. Note that the restoration unit 12 may not be provided depending on the skill level of the user U.

In this embodiment, when the movable part 10 moves to the right side, the seating surface 14*a* of the seat 14 is inclined to the right side. Likewise, when the movable part 10 moves to the left side, the seating surface 14*a* of the seat 14 is inclined to the left side. The tilt angles of the seating surface 14*a* in the above cases do not always coincide with the tilt angles of the pelvis. In this embodiment, the seat 14 can be tilted to the right and to the left with respect to the movable part body 30 by the universal joint 31, whereby the tilt angle of the seating surface 14*a* of the seat 14 follows the tilt angle of the pelvis of the user U and thus the comfort level of the seat 14 at the time of exercise is not impaired.

(Stabilizing Part 13)

Figure 11:
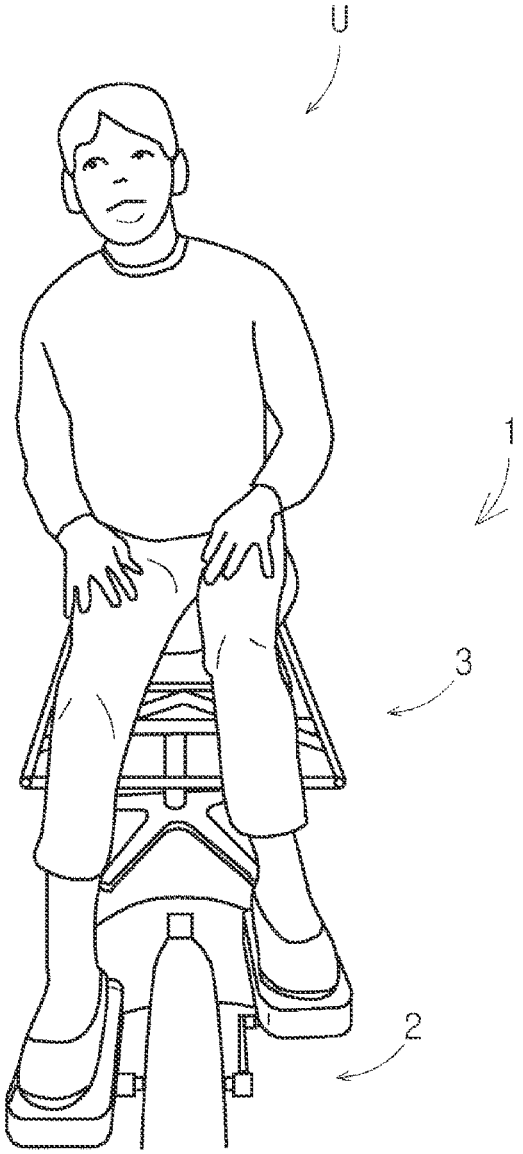
FIG. 11 is a front view of the lower limb exercise system.
Figure 12:
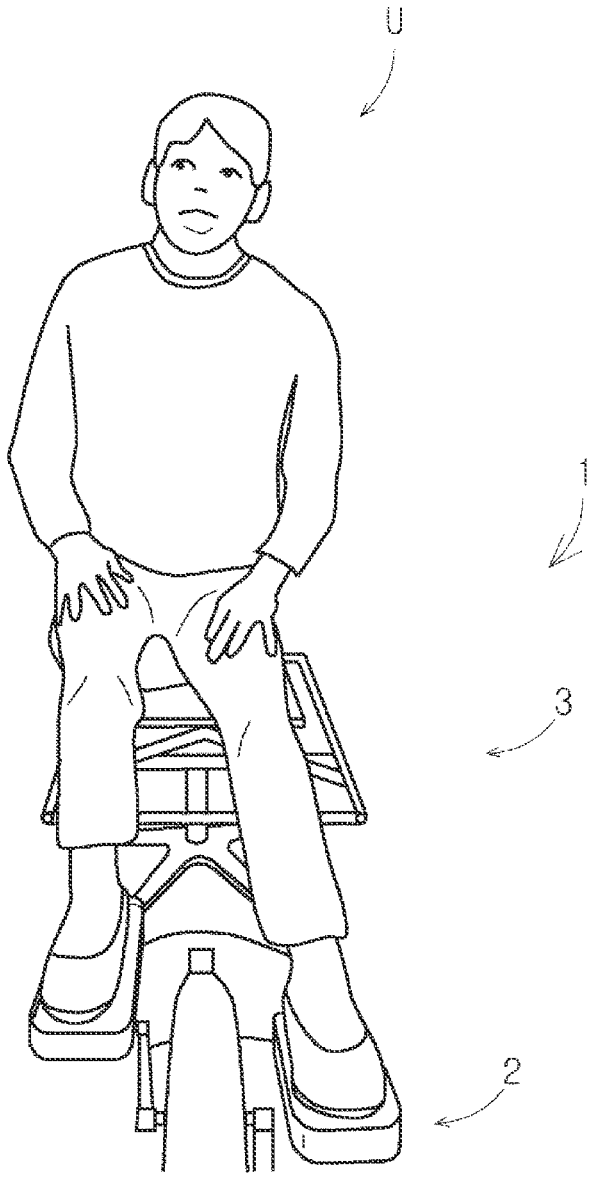
FIG. 12 is a front view of the lower limb exercise system.

Incidentally, when the motion linkage between the lower limbs and the trunk occurs, as shown in FIGS. 11 and 12, the head part and the both arms connected to the trunk are generally shaken in the right and the left. When, for example, the head part is shaken in the right and the left, it becomes difficult to read text and the like on a display placed on a desk. A similar problem occurs with a tablet display held by both hands. Further, when, for example, the both arms are shaken in the right and the left, it becomes difficult to input text by a keyboard placed on a desk. In this way, the motion linkage between the lower limbs and the trunk makes it difficult for a user to work or watch a movie during exercise. In some embodiments, the head part and the both arms may be prevented from being shaken while achieving the motion linkage between the lower limbs and the trunk.

Figure 13:
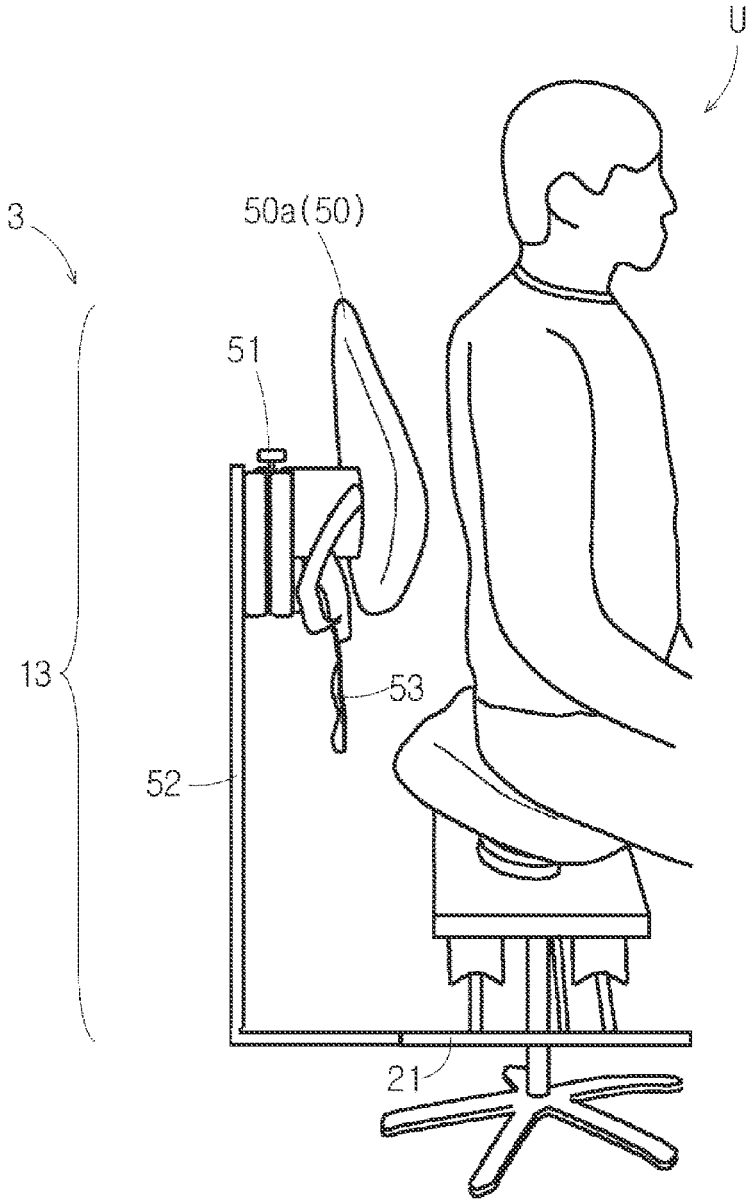
FIG. 13 is a side view of the chair.
Figure 14:
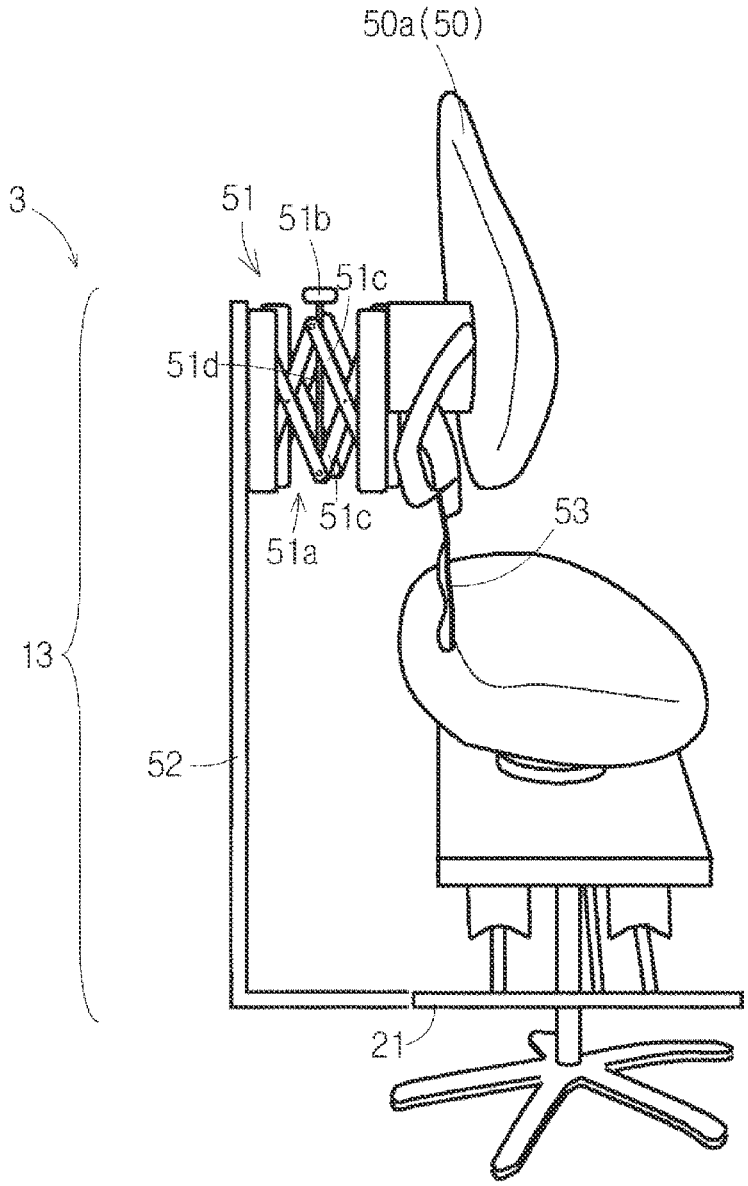
FIG. 14 is a side view of the chair.

In order to achieve the above object, as shown in FIGS. 13 and 14, the chair 3 according to this embodiment includes the stabilizing part 13 that stabilizes the posture of the user U while preventing the head part and the both arms of the user U from being shaken.

The stabilizing part 13 includes a backrest part 50, a position adjustment part 51, a coupling unit 52, and a fixing belt unit 53.

The backrest part 50 is a part opposed to the back of the user U. The backrest part 50 is supported by the position adjustment part 51. The backrest part 50 includes a pair of lumbar supports 50*a*. The pair of respective lumbar supports 50*a* are disposed so as to be opposed to the right area and the left area of the back of the user U. The pair of lumbar supports 50*a* are supported by the position adjustment part 51 via an elastic member. Therefore, each of the lumbar supports 50*a* can be swung to the right and to the left and upward and downward, and can follow the movement of the trunk of the user U. That is, even when the trunk of the user U turns around the yaw axis, it is possible to maintain a state in which at least one of the pair of lumbar supports 50*a* contacts the back of the user U.

The position adjustment part 51 is fixed to the frame 21 via the coupling unit 52. As shown in FIG. 14, the position adjustment part 51 includes a bellows shutter 51*a* that can be extended and retracted in the front-back direction and a grip 51*b* for adjusting the degree of extension and retraction of the bellows shutter 51*a*. The bellows shutter 51*a* is formed of a plurality of pairs of bellows frames 51*c*, each forming the X shape, aligned in the front-back direction. A screw 51*d* for adjusting the tilt angle of the pair of bellows frames 51*c* is coupled to the grip 51*b*. When the grip 51*b* is operated with the aforementioned configuration, the tilt angle of the pair of bellows frames 51*c* is increased or decreased, whereby the bellows shutter 51*a* is extended or retracted and the backrest part 50 moves back and forth. Therefore, by causing the backrest part 50 to move back and forth by operating the position adjustment part 51 in accordance with the skeleton of the user U, the backrest part 50 can be disposed in a suitable position with respect to the back of the user U.

The coupling unit 52 is configured in such a way that it can be extended and retracted vertically. Accordingly, it is possible to cause the backrest part 50 to move vertically in accordance with the skeleton of the user U and dispose the backrest part 50 in a suitable position with respect to the back of the user U.

The fixing belt unit 53 is used to fix the trunk of the user U to the backrest part 50. Specifically, as shown in FIG. 2, the fixing belt unit 53 is used to fix the part of the trunk of the user U above the solar plexus (the joint of the twelfth dorsal vertebra and the first lumbar vertebra) to the backrest part 50. This is because, if the part of the trunk of the user U above the solar plexus is fixed to the backrest part 50, it becomes possible to prevent shaking of the head part and the both arms of the user U, and the motion linkage between the lower limbs and the trunk is not inhibited since the pelvis is allowed to be swung.

In some embodiments, the fixing belt unit 53 fixes the base of the neck (the joint of the seventh cervical vertebra and the first dorsal vertebra) or the shoulder blade of the trunk of the user U to the backrest part 50. By fixing the base of the neck of the trunk of the user U to the backrest part 50, shaking of the head part can be efficiently prevented. Further, by fixing the shoulder blade of the trunk of the user U to the backrest part 50, shaking of the both arms can be efficiently prevented.

Referring continuously to FIG. 2, the fixing belt unit 53 is typically configured to fix the trunk of the user U to the backrest part 50 by coupling both end parts of the belt 53*a* held by the backrest part 50 by the buckle 53*b*. At this time, the length of the belt 53*a* may be adjusted using the buckle 53*b*. Alternatively, the both end parts of the belt 53*a* held by the backrest part 50 may be coupled by a hook-and-loop fastener or the belt 53*a* itself may be extended and retracted.

Described above is the first embodiment of the present disclosure. The first embodiment includes the following features.

As shown in FIGS. 1 to 4, a lower limb exercise system 1 (rowing exercise system) includes the chair 3 having the seat 14 on which the user U sits, and the rowing exercise device 2 used for rowing exercise while the user U sits on the seat 14. The seat 14 is configured at least to roll, pitch, or yaw. According to the above configuration, the motion linkage between the lower limbs and the trunk during the rowing exercise is achieved.

The seat 14 can instead be configured at least to roll and yaw. According to the above configuration, the motion linkage between the lower limbs and the trunk can be effectively achieved during the rowing exercise.

The rolling of the seat 14 indicates that the seat 14 descends as it moves away to the right or the left from the neutral position (reference position).

The chair 3 further includes the restoration unit 12 as a biasing member for biasing the seat 14 toward the reference position.

The chair 3 includes the movable part 10 including the seat 14, the supporting part 11 for supporting the movable part 10 movably to the right and left, and the backrest part 50 fixed to the supporting part 11. According to the above configuration, the head and both arms can be prevented from being shaken.

The chair 3 further includes the fixing belt unit 53 as a fixing member for fixing the trunk of the user U to the backrest part 50.

As shown in FIG. 2, the fixing belt unit 53 fixes the part of the user's trunk above the solar plexus to the backrest part 50. In some embodiments, the fixing belt unit 53 fixes the base of the neck or the shoulder blade of the trunk of the user U to the backrest part 50. According to the aforementioned configuration, it is possible to efficiently prevent shaking of the head part and the both arms.

Second Embodiment

A second embodiment will be described below with reference to FIG. 15.

Figure 15:
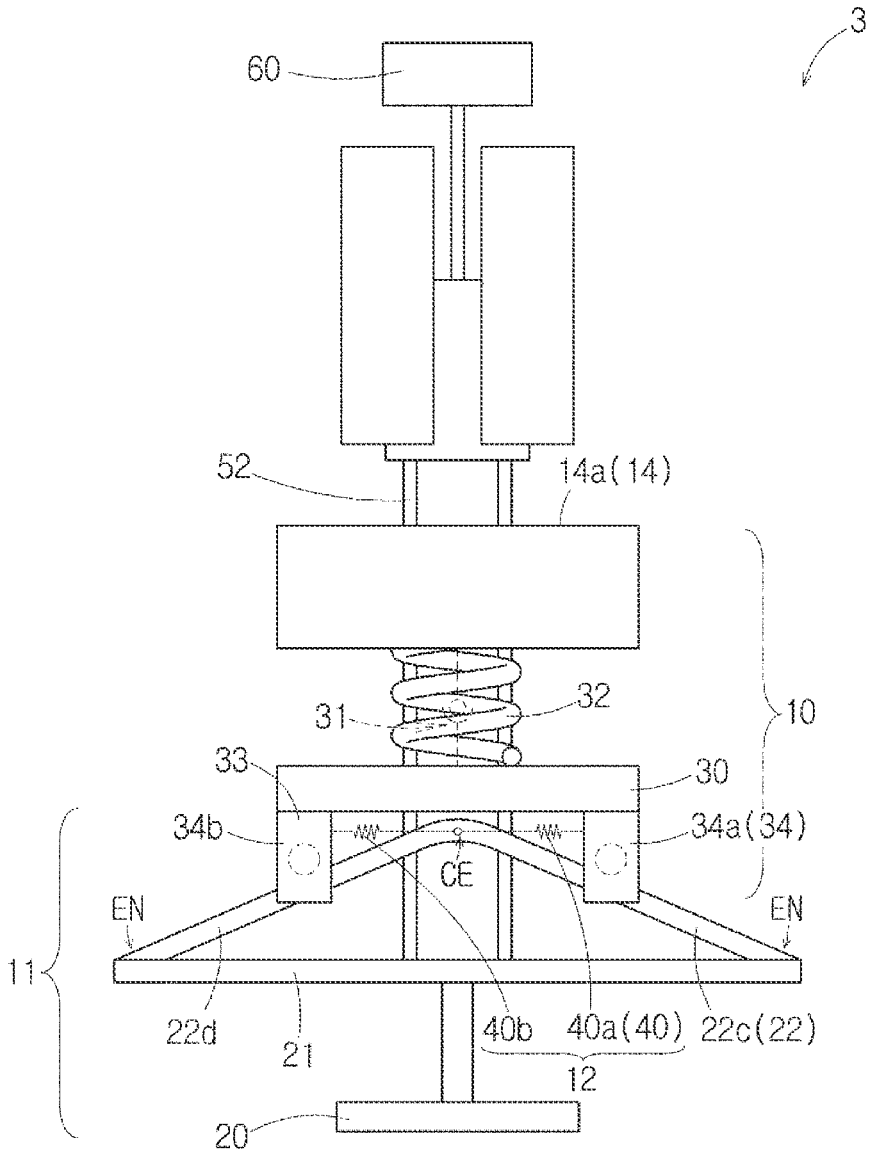
FIG. 15 is a front view of the chair.

As shown in FIG. 15, in this embodiment, a chair 3 includes a headrest 60 fixed to a frame 21. In this embodiment, the headrest 60 is fixed to the frame 21 via a coupling unit 52. According to the above configuration, shaking of the user U's head part can be efficiently prevented.

Although the first and second embodiments of the present disclosure have been described above, the above embodiments can be modified as follows.

In order to prevent the part of the trunk of the user U above the solar plexus from being shaken, the chair 3 may include a pair of arms that hold the part of the trunk of the user U above the solar plexus from the right and the left. The pair of arms are fixed to the supporting part 11.

Further, in order to prevent both arms of the user U from being shaken, the chair 3 may include a pair of armrests. The pair of armrests are fixed to the supporting part 11.

Further, in each of the aforementioned embodiments, the seat 14 is able to turn about the yaw axis with respect to the movable part body 30. However, alternatively, the seat 14 may be configured so as not to be able to turn about the yaw axis with respect to the movable part body 30 and to be able to turn about the yaw axis with respect to the supporting part 11. In this case, generally, a thrust bearing may be provided between the frame 21 and the leg part 20 so that the frame 21 can be made so as to be able to turn about the yaw axis with respect to the leg part 20. Alternatively, the movable part body 30 may be made so as to be able to turn about the yaw axis with respect to the pair of coupling parts 34, or the movable part body 30 may have a two-layer structure formed of an upper stage part and a lower stage part that overlap each other vertically, and a thrust bearing may be interposed between the upper stage part and the lower stage part. That is, as long as the seat 14 can turn about the yaw axis with respect to the space while the user U keeps sitting on the seat 14, the structure for attaining this configuration is not limited.

Supplementary Note

The disclosures embodied in the above embodiments may be supplemented by the following aspects.

As shown in FIGS. 1 to 4, the chair 3 includes the movable part 10 including the seat 14 on which the user U sits; the supporting part 11 configured to support the movable part 10 in such a way that the movable part 10 can be moved to the right and to the left; and the restoration unit 12, which is a biasing member for biasing the movable part 10 toward the neutral position in the right and the left. The supporting part 11 supports the movable part 10 in such a way that the movable part 10 descends as it is away from the neutral position. According to the aforementioned configuration, a chair that can be provided for a low cost, is highly convenient, and is capable of providing highly effective exercise can be provided.

Further, as shown in FIGS. 1 to 4, the chair 3 includes the movable part 10 including the seat 14 on which the user U sits; the supporting part 11 configured to support the movable part 10 in such a way that the movable part 10 can be moved to the right and to the left; and the restoration unit 12, which is a biasing member for biasing the movable part 10 toward the neutral position in the right and the left. The supporting part 11 supports the movable part 10 in such a way that the movable part 10 is swung to the right and to the left about the roll axis 10R that is extended backward and forward. The roll axis 10R is set below the movable part 10 when the movable part 10 is positioned at the neutral position. According to the aforementioned configuration, a chair that can be provided for a low cost, is highly convenient, and is capable of providing highly effective exercise can be provided.

Further, the supporting part 11 includes the two rails 22 that define the trajectory of the movement of the movable part 10 in the right and the left. The two rails 22 are inclined so as to descend toward the end part EN thereof from the center CE thereof in the longitudinal direction of the two rails 22. The movable part 10 moves along the two rails 22 of the supporting part 11.

Note that the supporting part 11 may be configured to include only one rail 22, not two rails 22.

Each of the rails 22 includes the right rail part 22*d* that is extended to the right from the center CE and the left rail part 22*c* that is extended to the left from the center CE. The movable part 10 includes the right coupling part 34*b* slidably coupled to the right rail part 22*d* and the left coupling part 34*a* slidably coupled to the left rail part 22*c*.

As shown in FIGS. 7 and 8, the seat 14 is configured so as to be able to turn about the yaw axis. According to the aforementioned configuration, the motion linkage between the lower limbs and the trunk is achieved more effectively.

As shown in FIG. 4, the movable part 10 further includes the movable part body 30 interposed between the supporting part 11 and the seat 14. The seat 14, which is mounted on the movable part body 30, is configured so as to be able to turn about the yaw axis with respect to the movable part body 30. According to the aforementioned configuration, the motion linkage between the lower limbs and the trunk is achieved more effectively.

As shown in FIGS. 9 and 10, the seat 14 is configured so that it can be tilted to the right and to the left and backward and forward with respect to the movable part body 30. According to the aforementioned configuration, a good fit of the seating surface 14*a* of the seat 14 to the buttocks of the user U while the movable part 10 is moving to the right and to the left can be provided.

As shown in FIG. 4, the movable part 10 further includes the universal joint 31 that couples the seat 14 to the movable part body 30, and the coil spring 32 that is disposed between the seat 14 and the movable part body 30 and resists tilting of the seat 14 with respect to the movable part body 30. According to the aforementioned configuration, it is possible to prevent the seat 14 from tilting excessively with respect to the movable part body 30.

The restoration unit 12 is formed of an elastic body. The restoration unit 12 includes, as the elastic body, the restoring coil springs 40. The restoration unit 12 may include, as the elastic body, rubber in place of the restoring coil springs 40.

As shown in FIGS. 13 and 14, the chair 3 further includes the backrest part 50 fixed to the supporting part 11. According to the aforementioned configuration, it is possible to prevent shaking of the head part and the both arms.

The chair 3 further includes the fixing belt unit 53, which is a fixing member for fixing the trunk of the user U to the backrest part 50.

As shown in FIG. 2, the fixing belt unit 53 fixes the part of the user's trunk above the solar plexus to the backrest part 50. In some embodiments, the fixing belt unit 53 fixes the base of the neck or the shoulder blade of the trunk of the user U to the backrest part 50. According to the aforementioned configuration, it is possible to efficiently prevent shaking of the head part and the both arms.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A pedaling exercise system comprising:

a front rail and a rear rail extending parallel to the front rail;

a chair supported by the front rail and the rear rail, the chair including a plate body, a seat on which a user sits, the seat coupled to an upper surface of the plate body, a pair of front coupling parts and a pair of rear coupling parts, the pair of front coupling parts and the pair of rear coupling parts coupled to a lower surface of the plate body, the pair of front coupling parts slidably coupled to the front rail to slide in a left-right direction and the pair of rear coupling parts slidably coupled to the rear rail to slide in the left-right direction;

a pair of front elastic bodies coupling the pair of front coupling parts to the front rail, and a pair of rear elastic bodies coupling the pair of rear coupling parts to the rear rail, the pair of front elastic bodies and the pair of rear elastic bodies configured to bias the seat towards a reference position when the seat slides in the left-right direction; and a pedaling exercise device configured to enable the user to perform pedaling exercise while the user remains sitting on the seat, wherein the seat is configured to at least roll, pitch, or and yaw.

2. The pedaling exercise system according to claim 1, wherein the chair further comprises:

a movable part including the seat;

a supporting part configured to support the movable part in such a way that the movable part is configured to be moved to the right and to the left; and a backrest part fixed to the supporting part.

3. The pedaling exercise system according to claim 2, wherein the backrest part further comprises a fixing belt configured to fix a trunk of the user to the backrest part.

4. The pedaling exercise system according to claim 3, wherein the fixing belt is configured to fix a part of the trunk of the user above the solar plexus to the backrest part.

5. The pedaling exercise system according to claim 3, wherein the chair further comprises a headrest fixed to the supporting part.

6. The pedaling exercise system according to claim 1, further comprising a stabilizing part comprising a frame coupling unit coupled to the supporting part, a position adjustment part coupled to the frame coupling unit, and a backrest part coupled to the position adjustment part, the backrest part comprising a pair of lumbar supports disposed so as to be opposed to a right area and a left area of a back of the user when the user is positioned in the seat.

7. The pedaling exercise system according to claim 6, wherein the position adjustment part comprises an elastic member supporting the pair of lumbar supports, such that the lumbar supports follow a movement of the back of the user while the user is positioned in the seat.

8. The pedaling exercise system according to claim 1, wherein the front rail and the rear rail open downwards on a descent from a rail center to a rail end part.

9. The pedaling exercise system according to claim 8, wherein the pair of front elastic bodies comprises a left elastic body positioned between one of the pair of front coupling parts and a center of the front rail and a right elastic body positioned between the other one of the pair of front coupling parts and the center of the front rail.

10. The pedaling exercise system according to claim 1, wherein the seat is configured to at least roll and yaw.

11. The pedaling exercise system according to claim 1, wherein the rolling of the seat indicates that the seat descends as the seat moves in the left-right direction away from a from the reference position.

12. The pedaling exercise system according to claim 1, wherein the pedaling exercise device is configured to be able to adjust a load.

13. The pedaling exercise system according to claim 1, wherein the pair of front elastic bodies are coil springs.

14. The pedaling exercise system according to claim 1, wherein the chair further comprises a universal joint coupling the seat and the plate body such that the seat may turn around a yaw axis, a pitch axis, a roll axis, or combinations thereof.

15. The pedaling exercise system according to claim 1, wherein the chair further comprises an elastic body disposed between the plate body and the seat.

16. The pedaling exercise system according to claim 1, wherein the front rail and the rear rail are connected to a frame having a leg part in contact with a floor surface, the frame supported by the leg part.

* * * * *